US005980063A

United States Patent [19]

Ford et al.

[11] Patent Number: 5,980,063

[45] Date of Patent: Nov. 9, 1999

[54] ILLUMINATED ELONGATED TUBULAR BODY

[76] Inventors: Timothy D.F. Ford, 7 Redfern Place, Beaconsfield, Québec, Canada, H8W 4M7; Michel S. Coté, 4191 de la Seine, Apt. 701, Laval, Québec, Canada, H7W 5E4

[21] Appl. No.: 08/937,021

[22] Filed: Sep. 24, 1997

[30] Foreign Application Priority Data

Jan. 3, 1997 [CA] Canada ..... 2194325

[51] Int. Cl.[6] ..... F21L 15/04

[52] U.S. Cl. ..... 362/186; 362/334; 362/555; 362/577; 359/709

[58] Field of Search ..... 362/102, 120, 362/186, 205, 208, 333, 334, 338, 340, 363, 555, 577, 293, 800; 359/709, 710, 712; 385/146

[56] References Cited

U.S. PATENT DOCUMENTS

| | | | |
|---|---|---|---|
| D. 38,056 | 6/1906 | Hogan | 362/327 |
| D. 331,889 | 12/1992 | Kaplan | D10/114 |
| D. 356,276 | 3/1995 | Liu et al. | D10/114 |
| D. 368,045 | 3/1996 | Akers | D10/114 |
| D. 370,276 | 5/1996 | Davis | D26/37 |
| 2,225,151 | 12/1940 | Borba | 362/102 |
| 2,245,349 | 6/1941 | Lombardi | 362/577 |
| 2,486,998 | 11/1949 | Szeklinski | 362/102 |
| 3,576,987 | 5/1971 | Voight et al. | 362/34 |
| 4,064,428 | 12/1977 | Van Zandt | 362/34 |
| 4,175,661 | 11/1979 | Barnes | 206/519 |
| 4,181,928 | 1/1980 | Zelina | 362/184 |
| 4,508,642 | 4/1985 | World | 252/700 |
| 4,740,874 | 4/1988 | Wylie et al. | 362/268 |
| 4,967,321 | 10/1990 | Cimock | 362/101 |
| 5,079,679 | 1/1992 | Chin-Fa | 362/102 |
| 5,152,598 | 10/1992 | Schaffer | 362/186 |
| 5,158,349 | 10/1992 | Holland et al. | 362/34 |
| 5,213,405 | 5/1993 | Giglia | 362/34 |
| 5,339,225 | 8/1994 | Wiggerman | 362/477 |
| 5,383,103 | 1/1995 | Pasch et al. | 362/102 |
| 5,444,606 | 8/1995 | Barnes et al. | 362/340 |
| 5,519,593 | 5/1996 | Hasness | 362/186 |
| 5,690,414 | 11/1997 | Jeng | 362/186 |

*Primary Examiner*—Alan Cariaso
*Attorney, Agent, or Firm*—Goudreau Gage Dubuc & Martineau Walker

[57] ABSTRACT

The present invention relates to a light stick comprising an electric light source and a light-refracting tubular body. The light-refracting tubular body has a longitudinal axis and is made of a translucent or transparent plastic material. The tubular body tapers from a first open end of larger diameter to a second closed end of smaller diameter. The light source is mounted in the open end of the tubular body with the power source housed in an adjoining cap which may be fitted onto the open end. The light source includes a LED aligned with the longitudinal axis of the tubular body, and a light-refracting network is formed on the internal surface of the body to project light emitted by the LED towards the side and the closed end of the tubular body. This network consists of a generally helicoidal thread. In operation, the light rays are refracted and radiated by the thread and the translucent or transparent plastic material forming the tubular body appears to glow evenly along its entire length. This threaded and tapered surface is particularly relevant and interesting since it allows easy disengagement of the tubular body from the plastic injection mold and works efficiently with many different electrical light sources. Optionally, the external surface of the tubular body includes a plurality of longitudinal projections, triangular or arced in cross section, to improve uniform light distribution along the tubular body.

17 Claims, 2 Drawing Sheets

ILLUMINATED ELONGATED TUBULAR BODY

BACKGROUND OF THE INVENTION

1. Field of the Invention

The present invention relates to an improved lighting structure that is efficient enough to transmit light from a low power LED along the entire surface of an elongated tubular body. The present invention is also concerned with the fabrication of such a tubular body by injection molding to provide for a water tight and impact resistant housing.

2. Brief Description of the Prior Art

The use of light-refracting elements is a well known art. Typically designs have revolved around lenses using various prismatic, angular, or rounded engravings or projections and complemented by transparent or translucent materials to either highlight or diffuse light.

Over the years many different versions of these lenses have appeared on a multitude of products ranging from light wands to automotive taillights and including common lighting fixtures. Numerous patents have been granted on these designs. Examples include the following U.S. patents:

| | | |
|---|---|---|
| 4,740,874 | Wylie et al. | 1988 |
| 5,519,593 | Hasness | 1996 |
| 5,339,225 | Wiggerman | 1994. |

OBJECTS OF THE INVENTION

The main object of the present invention is to emit light along an elongated tube or cone.

Another object of the invention is to provide a lens member that is efficient both below and above water.

A third object of the present invention is to provide a lens member emitting light visible throughout a 180° hemisphere.

Still further objects of the present invention comprise:

a) providing a lens member capable of working with various light sources including electrical and other light sources;

b) providing a lens member capable of working with LED's which typically are pre-focused along a relatively narrow beam;

c) providing a lens member capable of being injection molded in a housing that can withstand significant impact and water pressure without breaking; and d) providing a lens member having a design which enhances light sources and fixtures of various sizes and shapes.

SUMMARY OF THE INVENTION

More specifically, in accordance with the present invention, there is provided a lens member comprising an elongated tubular body made of light-propagating molded plastic material. This tubular body comprises an internal tapered surface formed with a generally helical thread. The helical thread defines a light-refracting network for refracting and radiating light generally uniformly along the tubular body.

The helical thread enables easy removal of the internal tapered surface of the tubular body from the mold surface by unscrewing, while producing adequate light refraction.

Also in accordance with the present invention, there is provided a light stick comprising an elongated tubular body made of light-propagating molded plastic material and including an internal tapered surface formed with a generally helical thread, and an end of larger diameter. The light stick also comprises a light source mounted in the tubular body at the end of larger diameter. The helical thread defines a light-refracting network for refracting and radiating light from the light source generally uniformly along the tubular body.

The light-propagating plastic material may be transparent or translucent. When this plastic material is translucent, it can also be colored.

In accordance with preferred embodiments, the tubular body is tapered and has a generally uniform thickness, the external surface of the tubular body is formed with a plurality of longitudinal light-refracting projections, and these longitudinal light-refracting projections have a generally triangular or arced cross section.

In accordance with a further preferred embodiment of the invention:

the tubular body has an end of smaller diameter, and this end of smaller diameter is closed;

the end of larger diameter of the tubular body is externally threaded to receive an internally threaded end cap structured to receive at least one battery for supplying the light source;

the light source comprises a low power light-emitting diode; and the light stick further comprises switching means for selectively connecting the battery to the light source and disconnecting this battery from the light source.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENT

Figures 1, 2, 3, 4, 5:
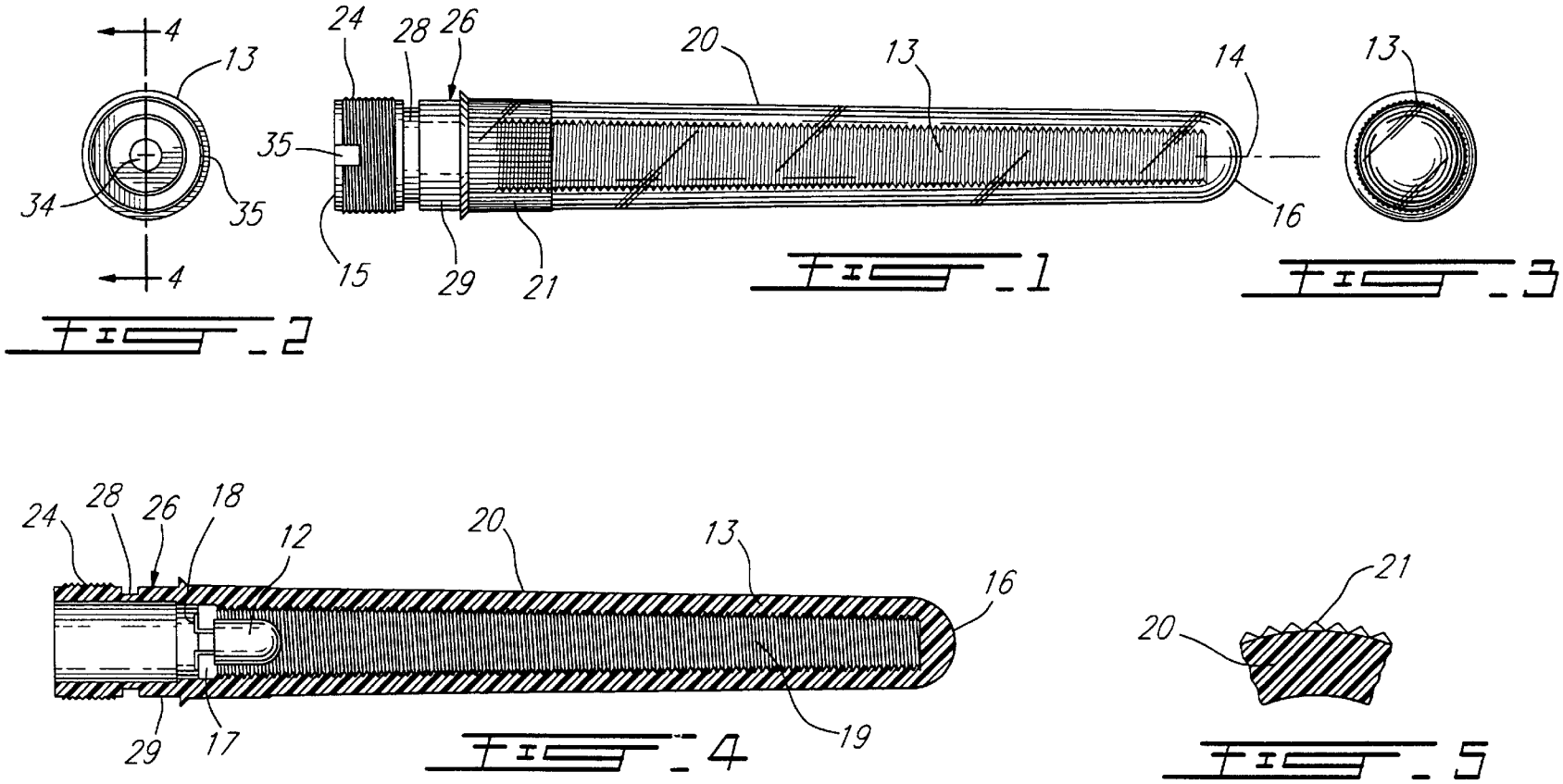
FIG. 1 is a side elevational view of a lens member according to the invention.
FIG. 2 is an elevational view of an open end of the lens member of FIG. 1.
FIG. 3 is an elevational view of a closed end of the lens member of FIG. 1.
FIG. 4 is a cross sectional, side elevational view of the lens member of FIG. 1, taken along line 4—4 of FIG. 2.
FIG. 5 is a partial, elevational end view of longitudinal light-refracting projections formed on the external surface of the lens member of FIG. 1.

In the different figures of the appended drawings, the corresponding elements are identified by the same reference numerals.

The preferred embodiment presented in the following description is concerned with a light stick approximately six inch long.

This light stick comprises an electric light source 12, a lens member embodied by an elongated, slightly tapering tubular light-refracting body 13, and a cap 22.

The tubular light-refracting body 13 has a longitudinal axis 14 (FIG. 1) and is made of a translucent or transparent light-propagating material, preferably a translucent or transparent light-propagating plastic material moldable by injection. The translucent light-propagating plastic material may also be colored. The injection-molded body 13 slightly tapers from a first open end 15 of larger diameter to a second closed end 16 of smaller diameter. In the illustrated example, the tubular body 13 has a generally uniform thickness.

The light source 12, a low power light-emitting diode (LED) in the illustrated example, is mounted onto a circular support board 17 (FIG. 4) made of electrically insulating material. The board 17 is fitted on an inner circular shoulder 18 formed in the open end 15 of the tubular body 13. The low power LED 12 is aligned with the longitudinal axis 14 of the tubular body 13.

A light-refracting (and also light-reflecting) network 19 (FIG. 4) is formed on the internal tapered surface of the tubular body 13 to project light emitted by the LED 12 towards the sides and the closed end 16 of the tubular body 13. The network 19 is constituted by a generally helical thread formed on the internal tapered surface of the tubular body 13. In operation, the light rays from the LED 12 are refracted (and eventually also reflected) and radiated by the thread 19, and the translucent or transparent light-propagating material forming the tubular body 13 appears to glow evenly along its entire length. The threaded and tapered internal surface of the tubular body 13 is particularly relevant and interesting since it allows easy disengagement of the tubular body 13 from the plastic injection mold by simple unscrewing and works efficiently as light-refracting surface with many different electric light sources.

Optionally, the external surface 20 of the tubular body 13 may include a plurality of generally longitudinal light-refracting projections such as 21 (FIGS. 1 and 5) to improve the uniform light distribution along the tubular body 13. The projections 21 may be arced or triangular in cross section as shown in FIG. 5.

Figure 9:
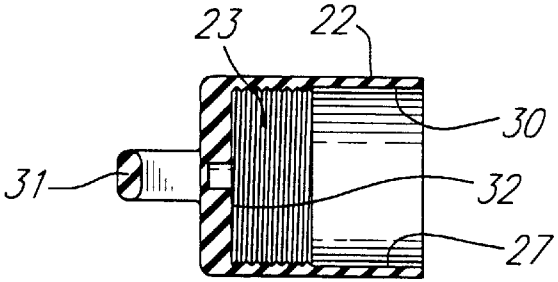
FIG. 9 is a cross sectional, side elevational view of the cap of FIG. 6, taken along line 9—9 of FIG. 7.
Figure 7:
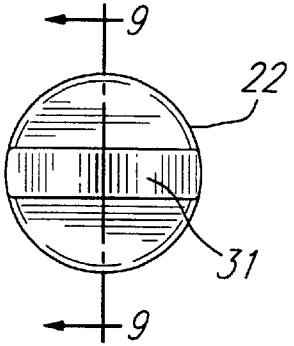
FIG. 7 is an elevational view of a closed end of the cap of FIG. 6.

The external surface 26 (FIGS. 1 and 2) of the open end 15 of the tubular body 13 has a threaded portion 24 to receive a threaded portion 23 (FIG. 9) of the internal surface 27 of the end cap 22.

The end cap 22 is provided to close and seal the open end 15 of the tubular body 13. For that purpose, the external surface 26 of the open end 15 of the tubular body 13 has a non threaded portion 29 formed with at least one circular channel 28 (FIGS. 1 and 2) to receive an O-ring (not shown) made of suitable material to seal the space between the non threaded portion 29 of the tubular body 13 and a non threaded portion 30 of the internal surface 27 of the cap 22. The closed end of the cap 22 is formed with an attachment loop member 31 to enable easy fastening of the light stick.

Figure 8:
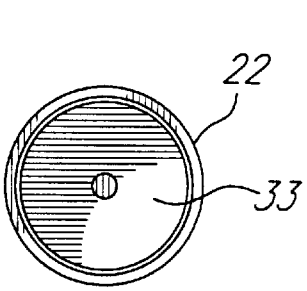
FIG. 8 is an elevational view of an open end of the cap of FIG. 6.
Figure 6:
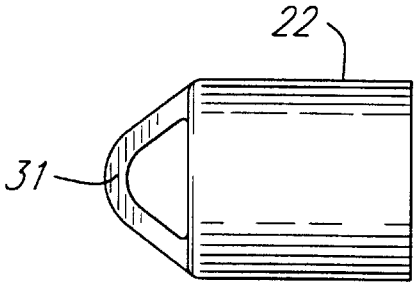
FIG. 6 is a side elevational view of a cap for closing the open end of the lens member of FIG. 1.

Obviously, the cap 22 will contain the power source, namely at least one battery for supplying the LED 12, between the bottom 32 (FIG. 9) of the cap 22 and the board 17 (FIG. 4). Those of ordinary skill in the art will appreciate that a conductive switching circuit can be designed and installed into the cap 22 (see 33 in FIG. 8) and the open end 15 of the tubular body 13 (see 34 and 35 in FIGS. 1 and 2) to enable turning on and turning off of the LED 12 by simply rotating the cap 22 with respect to the tubular body 13 about the longitudinal axis 14.

The light stick according to the invention presents, amongst others, the following advantages:

- it can work underwater;
- it is efficient both below and above water;
- the light emitted from the tubular body 13 is visible over a 180° hemisphere;
- it can work with various light sources including electric light sources and other types of light sources;
- it can work with LEDs which typically are pre-focused along a relatively narrow beam;
- it can be injection molded in a housing that could withstand significant water pressure without breaking; and
- it enhances light sources and fixtures of widely varying sizes and shapes.

Although an approximately six inch long light stick is described as preferred embodiment in the present application, this stick using a low power LED to illuminate the tubular body 13 and being capable of competing in brightness, duration, and durability with chemical light sticks and other battery powered light sticks and beacons, it should be pointed out that the present invention is usable into many other applications, and hence, that the light stick application is not intended to restrict the use of the invention herein disclosed to this particular application.

For example, other applications may comprise electrical source light wands of various sizes and configurations, and architectural and decorative lighting.

It is also within the scope of the present invention to increase or reduce the dimensions of the elongated, tubular tapered light-refracting lens member described hereinabove to provide an efficient bulb lens for various light sources where the above mentioned qualities are desirable, in particular where at least a 180° field of vision is desirable. Personal and commercial light beacons, decorative and architectural light bulbs and fixtures, signage backlighting and various illuminated toys are contemplated, and many other applications exist.

It is further within the scope of the present invention to use non electrical light sources, such as light transmitted through chemical reactions, fiber optics and light-emitting phosphors, to improve both the volume and uniformity of the light output. It is also envisioned that the light-refracting tubular body in larger sizes can be used as an improved light wand attachment to flashlights, in series as and improvement to signage backlighting, and in similar or smaller form as an improvement to current light bulb lenses, particularly where LEDs are involved.

Although the present invention has been described hereinabove with reference to a preferred embodiment thereof, this embodiment can be modified at will, within the scope of the appended claims, without departing from the spirit and nature of the subject invention.

What is claimed is:

1. A lens member comprising a one-piece elongated tubular body made of light-propagating molded plastic material, the tubular body comprising an internal tapered surface formed with a generally helical thread, wherein the helical thread defines a light-refracting network for refracting and radiating light generally uniformly along the tubular body.

2. A lens member as recited in claim 1, wherein said plastic material is transparent.

3. A lens member as recited in claim 1, wherein said plastic material is translucent.

4. A lens member as recited in claim 3, wherein said plastic material is colored.

5. A lens member as recited in claim 1, wherein the tubular body is an elongated, slightly tapering tubular body having a generally uniform thickness.

6. A light stick comprising:

a one-piece elongated tubular body made of light-propagating molded plastic material, including:

an internal tapered surface formed with a generally helical thread; and an end of larger diameter;

a light source mounted in the tubular body at the end of larger diameter; and wherein the helical thread defines a light-refracting network for refracting and radiating light from the light source generally uniformly along the tubular body.

7. A light stick as recited in claim 6, wherein said plastic material is transparent.

8. A light stick as recited in claim 6, wherein said plastic material is translucent.

9. A light stick as recited in claim 8, wherein said plastic material is colored.

10. A light stick as recited in claim 6, wherein the tubular body is an elongated, slightly tapering tubular body having a generally uniform thickness.

11. A light stick as recited in claim 6, wherein the tubular body has an end of smaller diameter, and wherein said end of smaller diameter is closed.

12. A light stick as recited in claim 6, wherein the end of larger diameter of the tubular body is externally threaded to receive an internally threaded end cap structured to receive at least one battery for supplying the light source.

13. A light stick as recited in claim 12, wherein said light source comprises a low power light-emitting diode.

14. A light stick as recited in claim 12, further comprising switching means for selectively connecting said at least one battery to the light source and disconnecting said at least one battery from said light source.

15. A lens member comprising an elongated tubular body made of light-propagating molded plastic material, the tubular body comprising:

an internal tapered surface formed with a generally helical thread; and an external surface formed with a plurality of longitudinal light-refracting projections; wherein the helical thread defines a light-refracting network for refracting and radiating light generally uniformly along the tubular body.

16. A light stick comprising:

an elongated tubular body made of light-propagating molded plastic material, including:

an internal tapered surface formed with a generally helical thread;

an external surface formed with a plurality of longitudinal light-refracting projections; and an end of larger diameter; and a light source mounted in the tubular body at the end of larger diameter;

wherein the helical thread defines a light-refracting network for refracting and radiating light from the light source generally uniformly along the tubular body.

17. A light stick as recited in claim 16, in which the longitudinal light-refracting projections have a generally triangular cross section.

* * * * *